US005095828A

United States Patent [19]

Holden et al.

[11] Patent Number: 5,095,828

[45] Date of Patent: Mar. 17, 1992

[54] THERMAL DECOMPOSITION OF WASTE MATERIAL

[75] Inventors: Harold H. Holden; Harold S. Holden; Andrew W. Marr, Jr., all of Ardmore, Okla.

[73] Assignee: Environmental Thermal Systems, Corp., Ardmore, Okla.

[21] Appl. No.: 625,836

[22] Filed: Dec. 11, 1990

[51] Int. Cl.[5] ..... F23G 5/00; F23G 5/10; F23G 5/12

[52] U.S. Cl. ..... 110/250; 110/235; 110/346

[58] Field of Search ..... 110/250, 346, 235, 259

[56] References Cited

U.S. PATENT DOCUMENTS

| | | | |
|---|---|---|---|
| 988,862 | 4/1911 | Conley . | |
| 3,173,388 | 3/1965 | Menrath et al. | 110/8 |
| 3,232,746 | 2/1966 | Karlovitz | 75/10 |
| 3,390,979 | 7/1968 | Greene | 75/11 |
| 3,445,191 | 5/1969 | Bruning et al. | 23/277 |
| 3,503,347 | 3/1970 | Marr, Jr. et al. | 110/8 |
| 3,522,015 | 7/1970 | Maniero et al. | 23/277 |
| 3,575,119 | 4/1971 | Marr, Jr. | 110/8 |
| 3,705,975 | 12/1972 | Wolf et al. | 219/383 |
| 3,749,803 | 7/1973 | Camacho | 13/9 |
| 3,765,870 | 10/1973 | Fey et al. | 75/10 R |
| 3,777,044 | 12/1973 | Nautny et al. | 13/33 |
| 3,791,949 | 2/1974 | Hirayama et al. | 204/171 |
| 3,819,840 | 6/1974 | Schultz | 13/1 |
| 4,122,293 | 10/1978 | Grigorenko et al. | 13/2 P |
| 4,129,742 | 12/1978 | Ward | 13/2 P |
| 4,414,672 | 11/1983 | Paton et al. | 373/22 |
| 4,479,443 | 10/1984 | Faldt et al. | 110/346 |
| 4,644,877 | 2/1987 | Barton et al. | 110/250 |
| 4,688,495 | 8/1987 | Galloway | 110/250 |
| 4,787,320 | 11/1988 | Raaness et al. | 110/250 |
| 4,909,164 | 3/1990 | Shohet et al. | 110/250 X |

FOREIGN PATENT DOCUMENTS

| | | | |
|---|---|---|---|
| 0146919 | 11/1981 | Japan | 110/250 |
| 0053780 | 3/1985 | Japan | 110/250 |

*Primary Examiner*—Edward G. Favors

*Attorney, Agent, or Firm*—Bill D. McCarthy; Glen M. Burdick

[57] ABSTRACT

A method and apparatus for the thermal decomposition of waste materials comprising an induction arc chamber having a thermal decomposed cavity formed therein and a plurality of electrode assemblies supported with the thermal decomposition cavity so that the electric arc gap formed between the electrode assemblies can be selectively varied to maintain a sufficiently high temperature in the thermal decomposition cavity to effect efficient decomposition of waste material in the induction arc chamber.

43 Claims, 4 Drawing Sheets

THERMAL DECOMPOSITION OF WASTE MATERIAL

BACKGROUND OF THE INVENTION

1. Field of the Invention

The present invention relates generally to decomposition of waste materials, and more particularly but not by way of limitation, to a method and apparatus for thermally decomposing hazardous waste materials.

2. Description of the Prior Art

A problem of major concern for today's society is the disposal of waste material, especially a group of substances which have been designated by both federal and state authorities as "hazardous waste material". Hazardous waste materials are generally chemical substances which consist of product mixtures, such as polychlorinated biphenols (PCB's), pentachlor phenols, organophosphorus, organonitrogen and organometallic compounds, as well as other materials that exist in large quantities and demand effective disposal procedures.

Of major concern in the disposal of hazardous waste materials is the fact that such materials are not only toxic, but such materials are in a composite matrix format often containing organic and inorganic components. Thus, the waste materials are generally thermally stable and not easily decomposed. Even when such compounds decompose, the result is that gases generated are often at least as toxic, if not more so, than the original waste material unless the decomposition process is highly controlled. Thus, the compounds themselves and any waste derived from the decomposition of such compounds may migrate into the ecological system in an uncontrolled manner when subjected to inferior decomposition processes.

The prior art is replete with various types of processes and apparatus for the decomposition of waste materials. Many of such processes employ combustion or incineration technology using various types of furnaces, incinerators or rotary kilns. More recently, plasma pyrolysis technology has been suggested as an effective method for the pyrolytic destruction of toxic waste materials.

Barton et al., U.S. Pat. No. 4,644,877, disclose the pyrolytic destruction of toxic or hazardous waste material using plasma torch technology wherein the waste materials are fed into a plasma arc burner for atomization and ionization prior to discharge into a reaction chamber to be cooled and recombined into product gas and particulate matter. The recombined products obtained from the cooling of the atomized and ionized waste material are quenched using a spray ring. An alkali atomized spray produced by the ring neutralizes the recombined products and wets the particulate matter. The product gas can then be extracted from the recombined products using a scrubber so that the product gas can be burned or used for fuel. Monitoring devices are employed in the apparatus to monitor the recombined products and to automatically shut down the apparatus if hazardous constituents are detected in the reaction chamber.

Faldt et al., U.S. Pat. No. 4,479,433 is also representative of the prior art relating to the thermal destruction of toxic or hazardous waste material using plasma torch technology.

Other methods for the disposal of hazardous waste materials, especially chemical substances such as polychlorinated biphenols (PCB's) have been proposed using the molten metal salt bath technology in which a molten metal salt bath is utilized in the decomposition of the waste materials. When employing the molten salt bath technology for the destruction of waste materials, the chemical substance sought to be destroyed and a source of oxygen are fed into a reactor containing the molten salt mixture which is maintained at a temperature of about 850° C. The chemical component is purportedly decomposed by pyrolysis and oxidation upon contact with the molten salt mixture. However, several inherent problems exist when employing the molten salt technology for the thermal destruction of hazardous waste materials, namely: (a) the molten salt mixture is depleted during the decomposition of chemical compounds and has to be replaced, and (b) solid waste products formed from the decomposition of the waste materials often create additional disposal problems.

Thus, while numerous methods and apparatus have heretofore been proposed by the prior art for the destruction of hazardous waste materials, and while much progress has been made in the disposal of such materials especially through advancements in the plasma torch technology, a need remains for improved methods and apparatus for decomposing hazardous waste materials which are effective and do not suffer from the disadvantages of the methods and apparatus of the prior art. It is to such a method and apparatus that the present invention is directed.

SUMMARY OF THE INVENTION

The present invention provides a method and apparatus for the thermal decomposition of waste materials in a simple, cost effective manner and which overcomes many of the disadvantages of the prior art methods and apparatus. Broadly, the apparatus of the present invention comprises an induction arc chamber having a thermal decomposition cavity formed therein and a plurality of electrode assemblies supported within the thermal decomposition so that an electric arc gap is formed therebetween. Upon electrically energizing the electrode assemblies a high temperature turbulent thermal zone is created in the thermal decomposition cavity. Each of the electrode assemblies is operably connected to a travel assembly so that the electric arc gap formed between oppositely disposed electrodes can be selectively varied by actuation of travel assemblies and thereby maintain a sufficiently high temperature in the thermal decomposition cavity of the induction arc chamber to effectively and efficiently decompose waste materials passed through the high temperature turbulent zone.

Waste materials, whether in a solid, liquid or gaseous state, introduced into the thermal decomposition cavity are maintained in contact with the high temperature turbulent zone for a period of time effective to thermally decompose the waste materials and form nontoxic products. As previously stated, the width of the electric arc gap of the electrode assemblies is variably controlled in order to insure that a sufficiently high temperature is maintained in the high temperature turbulent zone to effect the desired decomposition of the waste material. If desired, a thermal enhancement gas can be introduced into the decomposition cavity to further enhance the temperature of the high temperature turbulent zone within the decomposition cavity.

Gases produced by the thermal decomposition of the waste material are exhausted from the induction arc chamber for rapid cooling to avoid formation of toxic byproducts. The cooled gases can then be neutralized, if required, to provide substantially non-toxic byproducts which can be utilized as a fuel source, recovered for subsequent use as a reactant, or disposed of in an environmentally safe manner.

An object of the present invention is to provide a method and apparatus for the efficient and effective decomposition of waste materials.

Another object of the present invention, while achieving the before-stated object, is to provide a method and apparatus for the thermal decomposition of thermally stable chemical compounds, such as PCB's and other toxic compounds having a composite matrix format so as to produce stable, non-toxic substances.

A further object of the present invention, while achieving the before stated objects, is to provide a method and apparatus for thermal decomposition of hazardous waste materials wherein a wide variety of waste products can be decomposed into non-toxic products without major variations being required in either the apparatus or the method.

Still a further object of the present invention, while achieving each of the before stated objects, is to provide a method and apparatus in which the temperature at which decomposition occurs is independent of the thermal properties of the waste materials being decomposed.

Yet another object of the present invention, while achieving each of the before stated objects, is to provide a method and apparatus for thermal decomposition of waste materials which overcome the problems inherent in the apparatus heretofore employed.

Other objects, advantages and features of the present invention will become apparent from the following detailed description when read in conjunction with the appended claims.

DETAILED DESCRIPTION

Figure 1:
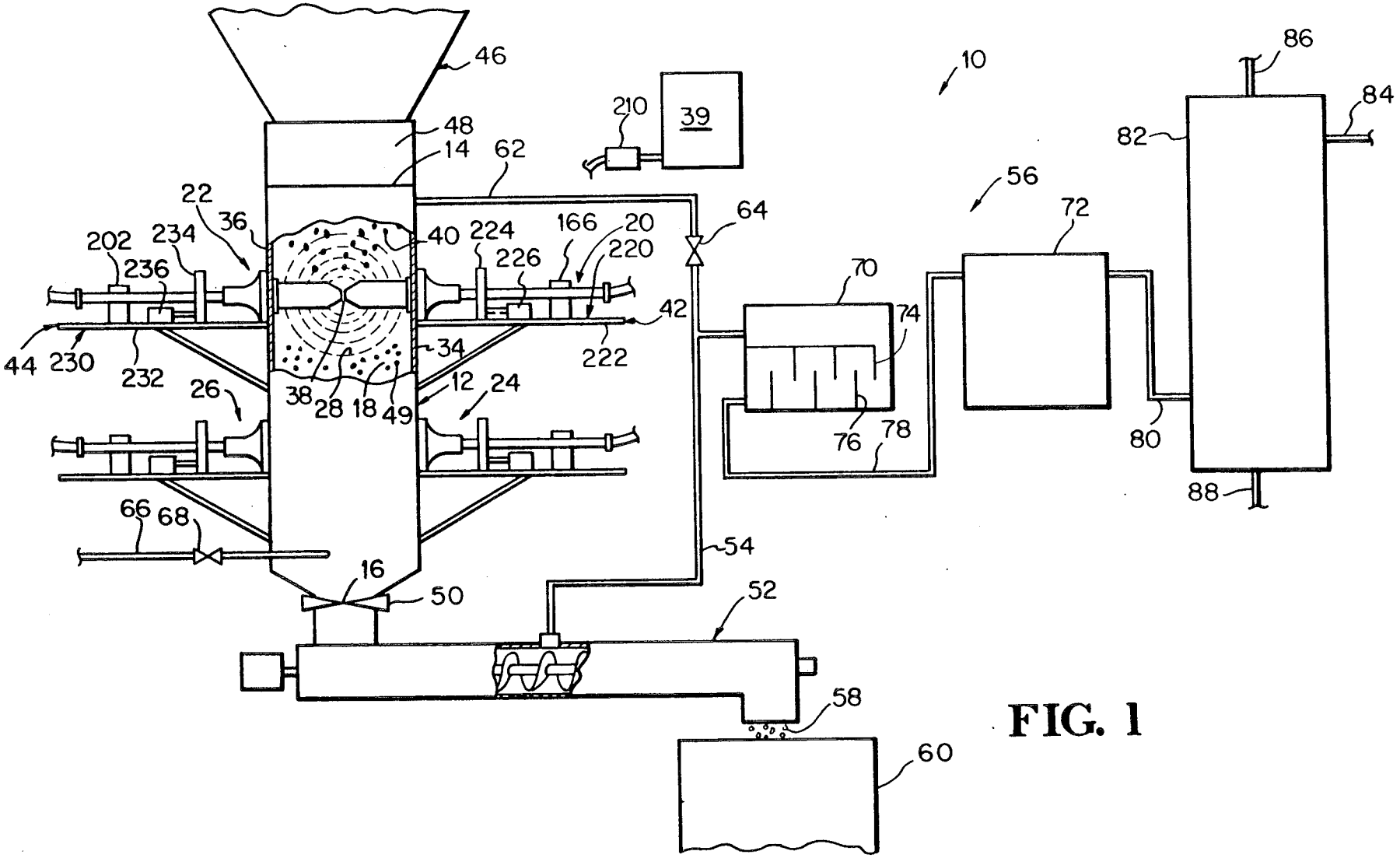
FIG. 1 is a schematic diagram illustrating an embodiment of the present invention.

In the thermal decomposition of waste materials the thermal stability of the compounds constituting the waste materials is one of the primary factors which must be considered in the efficient decomposition of such waste materials. Generally, four primary process factors must be controlled and balanced, namely (1) the temperature must be sufficiently high during a sufficiently long period of time in order to achieve decomposition of the compounds; (2) the reaction time, which must be linked to the temperature, must be sufficient to expose the compounds to the desired temperature of decomposition for a period of time sufficient to decompose all molecules of the compounds; (3) the oxidation potential must be sufficiently high to permit the decomposition of the compounds to stable final products such as $CO_2$, $H_2O$ and HCl in order to prevent a pyrolysis of different chemicals due to the lack of oxygen; and (4) the neutralization capacity for hydrochloric acid formed as a result of the decomposition of the waste materials is a factor of strength which tends to suppress the formation of chlorine during a decomposition process.

While it has heretofore been the view of the industry that only a plasma system could properly control each of the above referenced factors for the effective thermal decomposition of waste materials, especially hazardous waste materials such as PBC's, it has now been found that an apparatus constructed in accordance with the present invention and comprising at least one pair of electrode assemblies supported within a thermal decomposition cavity of an induction arc chamber so that the electric arc gap can selectively create a high temperature turbulent zone within the thermal decomposition cavity which effectively and efficiently decomposes waste materials and permits one to achieve the above described process parameters. That is, the activation of the electrodes establishes instantaneous heat within the thermal decomposition cavity without requiring heat build-up times. Thus, the residence time of waste materials in the high temperature turbulent zone is substantially reduced. Further, by variably controlling the electric arc gap between the pair of electrode assemblies one can effectively control the temperature in the high temperature zone to insure that a sufficiently high temperature is maintainable to decompose the waste materials introduced into the induction arc chamber.

Thus, the method and apparatus of the present invention allows one to achieve a necessary temperature/-time profile in order to achieve decomposition of the waste materials and represents an advancement in the state of the art relating to the thermal decomposition of waste materials, especially hazardous waste materials.

Reference will now be made in detail to the present preferred embodiments of the invention, examples of which are illustrated in the accompanying drawings. In the drawings, like numerals will be employed to identify like elements in the various embodiments.

Referring now to the drawings, and more particularly to FIG. 1, an apparatus 10 for the thermal decomposition of waste materials of the present invention is illustrated. The apparatus 10 comprises an induction arc chamber 12 having a waste inlet port 14, a residue outlet port 16 and a thermal decomposition cavity 18. A plurality of electrode assemblies 20, 22, 24 and 26 are supported by the induction arc chamber 12 so as to be disposed within the thermal decomposition cavity 18. When the electrode assemblies 20–26 are electrically energized, a high temperature turbulent zone 28 is produced within the thermal decomposition cavity 18. As previously stated, activation of the electrode assemblies 20–26 provides instantaneous heat within the thermal decomposition cavity 18 of the induction arc chamber 12 so that the residence time of the waste material in the thermal decomposition cavity 18 (and thus in contact with the high temperature turbulent zone 28) is substantially reduced. Each of the electrode assemblies 20–26 are substantially identical in construction and function. Thus, only the electrode assemblies 20 and 22, (which will hereinafter be referred to as the first electrode assembly 20 and the second electrode assembly 22) will be described in detail hereinafter.

The first and second assemblies 20, 22 extend through electrode ports 30, 32 (FIG. 2) formed in opposite sidewalls 34, 36 of the induction arc chamber 12 so as to extend into the thermal decomposition cavity 18. An electric arc ga 38 is formed between the first and second electrode assemblies 20, 22 so that when the first and second electrode assemblies 20, 22 are electrically energized by a power source 39 in a conventional manner the first and second electrode assemblies 20, 22 produce an electric arc which creates the high temperature turbulent zone 28 within the thermal decomposition cavity 18. The power source 39 can be either a D.C. power source or an A.C. power source. However, desirable results have been achieved where the power source is a D.C. power source.

To selectively maintain the electric arc gap 38 so that a suitable arc is provided to insure that a sufficiently high temperature is maintainable in the thermal decomposition cavity 18 to decompose waste materials 40 passed through the high temperature turbulent zone 28, the first electrode assembly 20 is operably connected to a first travel assembly 42 and the second electrode assembly 22 is operably connected to a second travel assembly 44. As will be more fully described hereinafter, the first and second travel assemblies 42, 44 selectively move the first and second electrode assemblies 20, 22 ( and thus vary the electric arc gap 38 therebetween) in response to the temperature of the high temperature turbulent zone 28 as determined by the energy requirements of the first and second electrode assemblies 20, 22.

Waste materials 40, when in a solid state, are introduced into the induction arc chamber 12 from a hopper assembly 46 via the waste inlet port 14. Because exhaust gases are generated during the thermal decomposition of the waste materials 40 in the induction arc chamber 12, an air lock 48 is operably connected to the induction arc chamber 12 so as to communicate with the waste inlet port 14. The air lock 48 regulates solids flow into the induction arc chamber 12 and prevents all gases generated from the decomposition of waste materials from flowing upwardly through the waste inlet port 14 and into the hopper assembly 46. Air locks are well known in the art. Thus, no further description of the air lock 48 is believed necessary to enable one skilled in the art of fully understand the inventive concept of the present invention.

In the thermal decomposition of the waste materials 40 a solids residue 49 (i.e., ash) is formed as well as the exhaust gases. The solids residue 49 is dischargeable from the induction arc chamber 12 through a valve 50 which selectively opens and closes the residue outlet port 16 of the induction arc chamber 12. The solids residue 49 discharged from the induction arc chamber 12 via the valve 50 and the residue outlet port 16 is fed into an auger assembly 52 wherein entrained exhaust gases are removed from the solids residue 49. The separated exhaust gases are vented from the auger assembly 52 into a conduit 54 which is connected to a cooling system 56 wherein the exhaust gases are rapidly cooled and entrained or suspended particulate materials are removed. A substantially gas-free solids residue 58 is discharged from the auger assembly 52 into a suitable container 60. The substantially gas-free solids residue 58, which is non-toxic, can then be disposed of in an environmentally safe manner.

In addition to the separation of exhaust gases from the solids residue 49 in the auger assembly 52, it may also be desirable to vent exhaust gases from the induction arc chamber 12 for passage to the cooling system 56. In such instance, the induction arc chamber 12 is provided with an exhaust port (not shown) which is in fluid communication with the cooling system 56 via a conduit 62 and a valve 64. While the apparatus 10 has been illustrated as containing conduits 54, 62 for passage of exhaust gases vented from the induction arc chamber 12 and from the auger assembly 52, it is to be understood that the elimination of one of the conduits 54, 62 would enable one to still practice the inventive concept of the present invention wherein the waste materials 40 are thermally decomposed to non-toxic products in the induction arc chamber 12.

To insure that the temperature of the high temperature turbulent zone 28 zone is maintained at a sufficiently high temperature, as well as to assist in the thermal decomposition of certain waste materials, it may be desirable to introduce a thermal enhancement fluid into the induction arc chamber 12 when the first and second electrode assemblies 20, 22 are energized. In such instance, a thermal enhancement fluid can be introduced into the induction arc chamber 12 via an inlet port (not shown) of the induction arc chamber 12 and a conduit 66 and a valve 68. As previously stated, gases produced during the thermal decomposition of the waste materials 40 are vented from the induction arc chamber 12 and/or the auger assembly 52 and passed to the cooling system 56 wherein the exhaust gases are rapidly cooled to prevent formation of toxic substances during the cooling of the exhaust gases, while at the same time removing entrained or suspended particulate materials from the cooled exhaust gases. The cooling system 56 comprises a cooling unit 70 and a baghouse 72. The cooling unit 70 is provided with an array of downwardly extending baffles 74 and an array of upwardly extending baffles 76 (substantially as shown) so that the exhaust gases are caused to travel along a serpentine pathway through the cooling unit 70 which enhances the rapid cooling of such gases. The cooled exhaust gases exit the cooling unit 70 and are passed to the baghouse 72, via a conduit 78, wherein entrained or suspended particulate materials are removed to provide a substantial particulate-free exhaust gas stream.

The substantially particulate-free exhaust gas stream is passed from the baghouse 72 via a conduit 80 to a trayed tower 82 or the like wherein the substantially particulate-free exhaust stream is neutralized, if required, prior to venting to the atmosphere, or passage to a collection system (not shown) via a conduit 84. When it is determined that the substantially particulate-free exhaust gas stream is to be neutralized, a neutralizing agent is introduced into the trayed tower 82 via a conduit 86. Liquids resulting from the neutralization of the substantially particulate-free exhaust gas stream and or separated from the exhaust gas stream are withdrawn from the trayed tower 82 via a conduit 88.

The auger assembly 52, the cooling system 56 (which includes the cooling unit 70 and the baghouse 72) and the trayed tower 82 are conventional components well known in the art. Thus, no further description of such components is believed necessary to enable one skilled in the art to understand and practice the present invention.

As previously stated, the first electrode assembly 20 extends through the electrode port 30 in the sidewall 34 of the induction arc chamber 12; and the second electrode assembly 22 extends through the electrode port 32 in the sidewall 36 of the induction arc chamber 12. The first and second electrode assemblies 20, 22 are connected to the power source 39 in a conventional manner so that upon activation of the power source 39 the first and second electrode assemblies 20, 22 are electrically energized and thereby produce an electric arc which creates the high temperature turbulent zone 28 in the thermal decomposition cavity 18 of the induction arc chamber 12.

Figure 2:
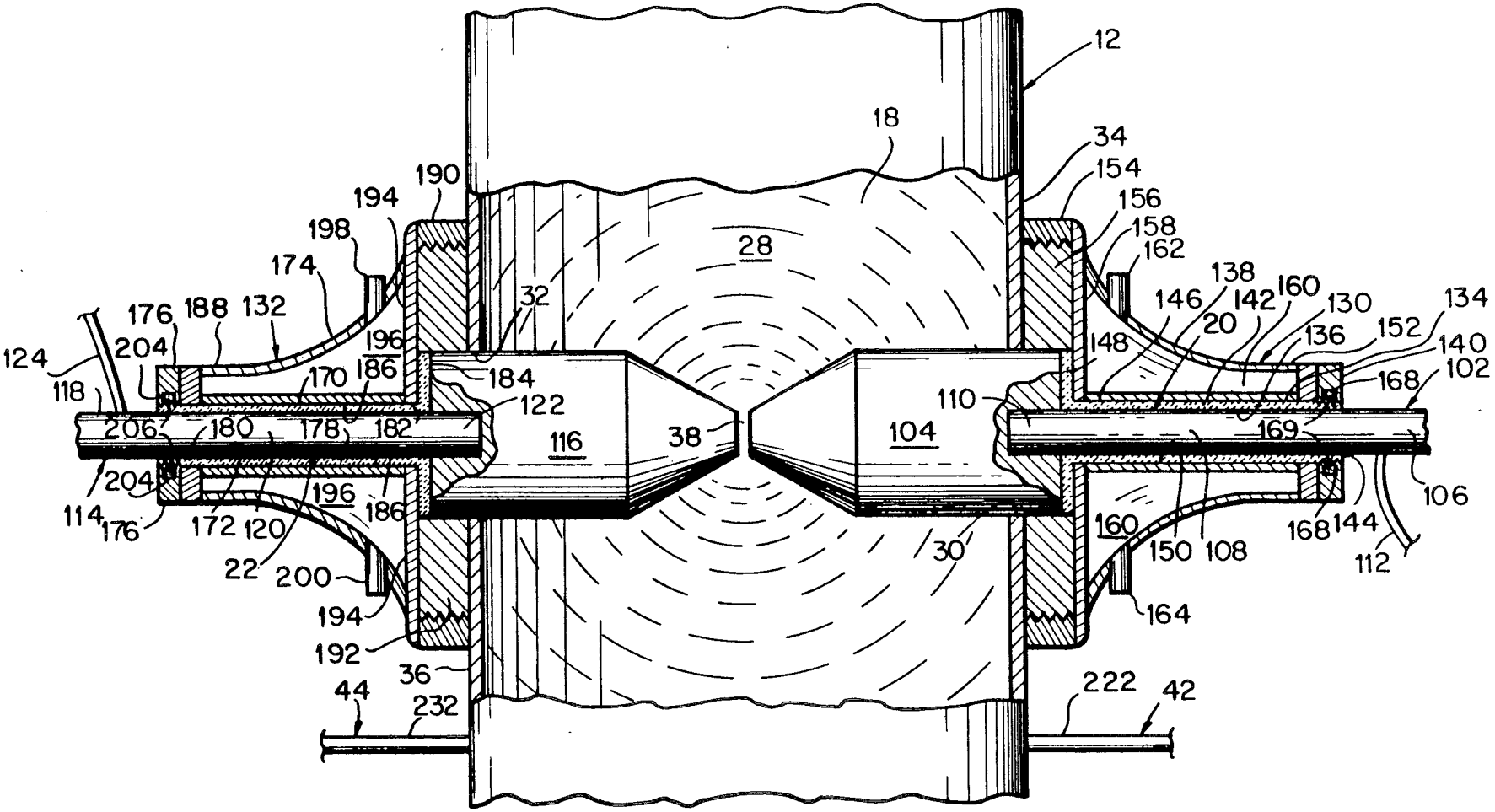
FIG. 2 is a fragmental, enlarged cross-sectional view of an induction arc chamber having a pair of electrode assemblies supported within a thermal decomposition cavity of the induction arc chamber.

As more clearly shown in FIG. 2, the first electrode assembly 20 comprises a first conducting member 102 and a first electrode member 104. The first conducting member 102 is characterized as an elongated member having a first end portion 106, a medial portion 108 and an opposed second end portion 110. The first end portion 106 of the first conducting member 102 is operably connected to the power source 39 via a cable member 112 and to the first travel assembly 42; while the opposed second end portion 110 of the first conducting member 102 is connected to the first electrode member 104. Thus, the first conducting member 102 and the first electrode member 104 can be reciprocally moved along a travel path in a to and fro direction in response to actuation of the first travel assembly 42 (FIG. 1) which in turn is actuated in response to the temperature of the high temperature turbulent zone 28 as determined by the energy requirement of the first and second electrode assemblies 20, 22.

Similarly, the second electrode assembly 22 comprises a second conducting member 114 and a second electrode member 116. The second conducting member 114 is characterized as an elongated member having a first end portion 118, a medial portion 120 and an opposed second end portion 122. The first end portion 118 of the second conducting member 114 is operably connected to the power source 39 via a cable member 124 and to the second travel assembly 44 (FIG. 1); while the opposed second end portion 122 of the second conducting member 114 is connected to the second electrode member 116. Thus, the second conducting member 114 and the second electrode member 116 can be selectively reciprocally moved along a travel path in a to and fro direction relative to the first electrode member 104 in response to actuation of the second travel assembly 44 which is actuated in response to the temperature of the high temperature turbulent zone 28.

The apparatus 10 further comprises a first sealing and cooling assembly 130 connected to the induction arc chamber 12 so as to form a fluid-tight seal between the medial portion 108 of the first conducting member 102 and the electrode port 30, while permitting a cooling fluid such as $CO_2$ to be circulated about the medial portion 108 of the first conducting member 102. Similarly, a second sealing and cooling assembly 132 is connected to the induction arc chamber 12 so as to form a fluid-tight seal between the medial portion 120 of the second conducting member 114 and the electrode port 32, while permitting a cooling fluid such as $CO_2$ to be circulated about the medial portion 120 of the second conducting member 114. As will be more fully described hereinafter, the first and second sealing and cooling assemblies 130, 132 (while providing a fluid-tight seal between the medial portions 108 and 120 of the first and second conducting members 102, 114, respectively, and the electrode ports 30, 32) are constructed so that the first and second conducting members 102 and 114 of the first and second electrode assemblies 20, 22 can be reciprocally moved through the first and second sealing and cooling assemblies 130, 132. Thus, the electric arc gap 38 formed between the first and second electrode members 104 and 116 can be selectively varied to insure that a sufficiently high temperature is maintainable in the thermal decomposition cavity 18 when the first and second electrode assemblies 20, 22 are electrically energized by the power source 39.

Further, it may be desirable to rotate one or more of the first and second electrode assemblies 20, 22 to enhance decomposition of the waste materials 40 and to maintain suitable turbulence within the high temperature turbulent zone 28, especially when the waste materials 40 are in the fluid state. Thus, the first and second sealing and cooling assemblies 130, 132 are also constructed to permit rotation of the first and second electrode assemblies 20 and 22.

The first sealing and cooling assembly 130 comprises a sleeve member 134 having an electrode receiving passageway 136 extending therethrough, a housing 138 disposed about the sleeve member 134 and a seal ring member 140 for providing a substantially fluid-tight seal between the sleeve member 134, the housing 138 and the medial portion 108 of the first conducting member 102 of the first electrode assembly 20.

The sleeve member 134, which is fabricated of a heat resistant material such as ceramic, is characterized as having a body portion 142 having a threaded first end portion 144 and an opposed second end portion 146. A flange 148 is formed on the opposed second end portion 146 such that in an assembled position the medial portion 108 of the first conducting member 102 is disposed within the electrode receiving passageway 136 of the sleeve member 134 and the flange 148 abuttingly engages the housing 138 of the first sealing and cooling assembly 130 substantially as shown.

The housing 138 is also provided with a passageway 150 extending therethrough which is adapted to receive the body portion 142 of the sleeve member 134. The housing 138 is characterized as having a first end portion 152 and an enlarged threaded second end portion 154. The first end portion 152 of the housing 138 terminates substantially adjacent the threaded first end portion 144 of the sleeve member 134 so that the seal ring member 140 can be secured to the threaded first end portion 144 of the sleeve member 134 to provide the fluid-tight seal between the first end portion 152 of the housing 138 and the threaded first end portion 144 of the sleeve member 134. The enlarged threaded second end portion 154 of the housing 138 is adapted to threadably engage a threaded collar member 156 secured to the sidewall 34 of the induction arc chamber 12 so as to encompass the electrode port 30 substantially as shown. The housing 138 is further provided with a recessed end plate 158 which abuttingly engages the flange 148 of the sleeve member 134 when same are in the assembled position.

As illustrated in FIG. 2, the housing 138 is a hollow member defining a cavity 160 therein; and the housing 138 is further provided with a fluid inlet port 162 and a fluid outlet port 164, each of which communicates with the cavity 160 so that cooling fluid can be injected into the cavity 160 for circulation about the body portion 142 of the sleeve member 134 and thereby cool the first conducting member 102 of the first electrode assembly 20.

The medial portion 108 of the first conducting member 102 of the first electrode assembly 20 is slideably disposed in the electrode receiving passageway 136 of the sleeve member 134 so that the electric arc gap 38 formed between the first and second electrode members 104, 116 can be selectively varied in response to the temperature of the high temperature turbulent zone 28 in the thermal decomposition cavity 18 as determined by the energy requirements of the first and second electrode assemblies 20, 22. Further, when desired, the opposed second end portion 110 of the first conducting member 102 can be operably connected to a drive source, such as motor 166 (See FIG. 1), so that upon activation of the motor 166 rotational movement is imparted to the first conducting member 102 and to the first electrode member 104 about their longitudinal axis so as to enhance the effective operation of the apparatus 10. Thus, the electrode receiving passageway 136 of the sleeve member 134 is sized so that the desired reciprocal and rotational movement of the first electrode assembly 20 can be achieved, while forming an effective seal with the medial portion 108 of the first conducting member 102 so that gases generated during the thermal decomposition of the waste materials 40 in the high temperature turbulent zone 28 of the thermal decomposition cavity 18 are prevented from escaping therethrough.

To further enhance a fluid-tight seal between the medial portion 108 of the first conducting member 102 and the sleeve member 134, the threaded first end portion 144 of the sleeve member 134 is provided with an interiorly disposed recess 168 adapted to receive a sealing ring 169. Thus, when the seal ring member 140 is threadably connected to the threaded first end portion 144 of the sleeve member 134 a force is exerted on the sealing ring 169 so as to enhance a seal between the medial portion 108 of the first conducting member 102 and the seal ring member 140. The sealing ring 169 can be fabricated of any suitable material. However, desirable results have been obtained when the sealing ring 169 is fabricated of phenolite.

The second sealing and cooling assembly 132 is similar in construction to the first sealing and cooling assembly 130 and thus comprises a sleeve member 170 having an electrode receiving passageway 172 extending therethrough, a housing 174 disposed about the sleeve member 170 and a seal ring member 176 for providing a substantially fluid-tight seal between the sleeve member 170, the housing 174 and the medial portion 120 of the second conducting member 114 of the second electrode assembly 22.

The sleeve member 170, which is fabricated of a heat resistant material such as ceramic, is characterized as having a body portion 178 having a threaded first end portion 180 and an opposed second end portion 182. A flange 184 is formed on the opposed second end portion 182 such that in an assembled position the medial portion 120 of the second conducting member 114 is disposed within the electrode receiving passageway 172 and the flange 184 of the sleeve member 170 abuttingly engages the housing 174 of the second sealing and cooling assembly 132 substantially as shown.

The housing 174 is also provided with a passageway 186 extending therethrough adapted to receive the body portion 178 of the sleeve member 170. The housing 174 is characterized as having a first end portion 188 and an enlarged threaded second end portion 190. The first end portion 188 of the housing 174 terminates substantially adjacent the threaded first end portion 180 of the sleeve member 170 so that the seal ring member 176 can be secured to the threaded first end portion 180 of the sleeve member 170 to provide the fluid-tight seal between the first end portion 188 of the housing 174 and the threaded first end portion 180 of the sleeve member 170. The enlarged threaded second end portion 190 is adapted to threadably engage a threaded collar member 192 secured to the sidewall 36 of the induction arc chamber 12 so as to encompass the electrode port 32 (substantially as shown). The housing 174 is further provided with a recessed end plate 194 which abuttingly engage the flange 184 of the sleeve member 170 when same are in the assembled position.

The housing 174 is a hollow member defining a cavity 196 therein; and the housing 174 is further provided with a fluid inlet port 198 and a fluid outlet port 200, each of which communicates with the cavity 196 so that cooling fluid can be injected into the cavity 196 for circulation about the body portion 178 of the sleeve member 170 and thereby cool the second conducting member 114 of the second electrode assembly 22.

The medial portion 120 of the second conducting member 114 of the second electrode assembly 22 is slideably disposed in the electrode receiving passageway 172 of the sleeve member 170 so that the electric arc gap 38 formed between the first and second electrode members 104, 116 can be selectively varied in response to the temperature in the high temperature turbulent zone 28 formed in the thermal decomposition cavity 18. Further, when desired, the opposed second end portion 122 of the second conducting member 114 of the second electrode assembly 22 can be operably connected to a drive source, such as a motor 202 (see FIG. 1), so that upon activation of the motor 202 rotational movement is imparted to the second conducting member 114 and to the second electrode member 116 about their longitudinal axis so as to enhance the effective operation of the apparatus 10. Thus, the electrode receiving passageway 172 of the sleeve member 170 is sized so that the desired reciprocal and rotational movement of the second electrode assembly 22 can be achieved while forming an effective seal with the medial portion 120 of the second conducting member 114 so that gases generated during thermal decomposition of the waste materials 40 in the high temperature turbulent zone 28 of the thermal decomposition cavity 18 are prevented from escaping therethrough.

To further enhance a fluid-tight seal between the medial portion 120 of the second conducting member 114 and the sleeve member 170, the threaded first end portion 180 of the sleeve member 170 is provided with an interiorly disposed recess 204 adapted to receive a sealing ring 206. Thus, when the seal ring member 176 is threadably connected to the threaded first end portion 180 of the sleeve member 170 a force is exerted on the sealing ring 206 so as to enhance a seal between the medial portion 120 of the second conducting member 114 and the seal ring member 176. The sealing ring 206 can be fabricated of any suitable material. However, desirable results have been obtained when the sealing ring 206 is fabricated of phenolite.

As previously stated, the first and second electrode assemblies 20, 22 are operably connected to the first and second travel assemblies 42, 44 respectively, so that the first and second electrode assemblies 20, 22 (and thus the first and second electrode members 104, 116) can be reciprocally moved relative to each other in order to vary the electric arc gap 38 and thereby assure that a sufficiently high temperature is maintainable within the high temperature turbulent zone 28 to decompose the waste materials 40.

In order to control the width of the electric arc gap 38 so that a desired temperature is maintained in the high temperature turbulent zone 28, the apparatus 10 further comprises a sensing and control assembly 210 capable of measuring and controlling the energy or power supplied to the first and second electrode assemblies 20, 22 so that the width of the electric arc gap 38 is varied to maintain the desired temperature in the high temperature turbulent zone 28.

Thus, when electrode assemblies are energized so that an electric arc is formed across the electric arc gap, such as the electric arc gap 38 shown in FIG. 2, the energy required to effectively operate the first and second electrode assemblies to produce the electric arc gap 38 is measured by the sensing and control assembly 210. The sensing and control assembly 210 then provides a signal to the first and second travel assemblies 42, 44 to selectively activate the travel assemblies 42, 44, if required, to vary the width of the electric arc gap 38 so that the high temperature turbulent zone 28 is maintained at a selected temperature.

The first travel assembly 42 comprises a first carriage assembly 220 which includes a first carriage platform 222, a first upright support member 224 and a first drive unit, such as a step motor 226. The first carriage platform 222, which defines a travel path for the first upright support member 224 and thus the first electrode assembly 20, is connected to the induction arc chamber 12 so as to be disposed below, but aligned with, the electrode port 30 of the induction arc chamber 12. The step motor 226 is operably connected to the first upright support member 224 so that upon actuation of the step motor 226 by the sensing and control assembly 210, the first conducting member 102 and the first electrode member 104 are reciprocally moved along the travel path defined by the first carriage platform 222.

Similarly, the second travel assembly 44 comprises a second carriage assembly 230 which includes a second carriage platform 232, a second upright support member 234 and a second drive unit, such as a second step motor 236. The second carriage platform 232, which defines a travel path for the second upright support member 234, and thus the second electrode assembly 22, is connected to the induction arc chamber 12 so as to be disposed below, but aligned with, the electrode port 32 of the induction arc chamber 12. The second step motor 236 is operably connected to the second upright support member 234 so that upon actuation of the second step motor 236 by the sensing and control assembly 210 the second conducting member 114 and the second electrode member 116 are reciprocally moved along the travel path defined by the second carriage platform 232.

Figure 3:
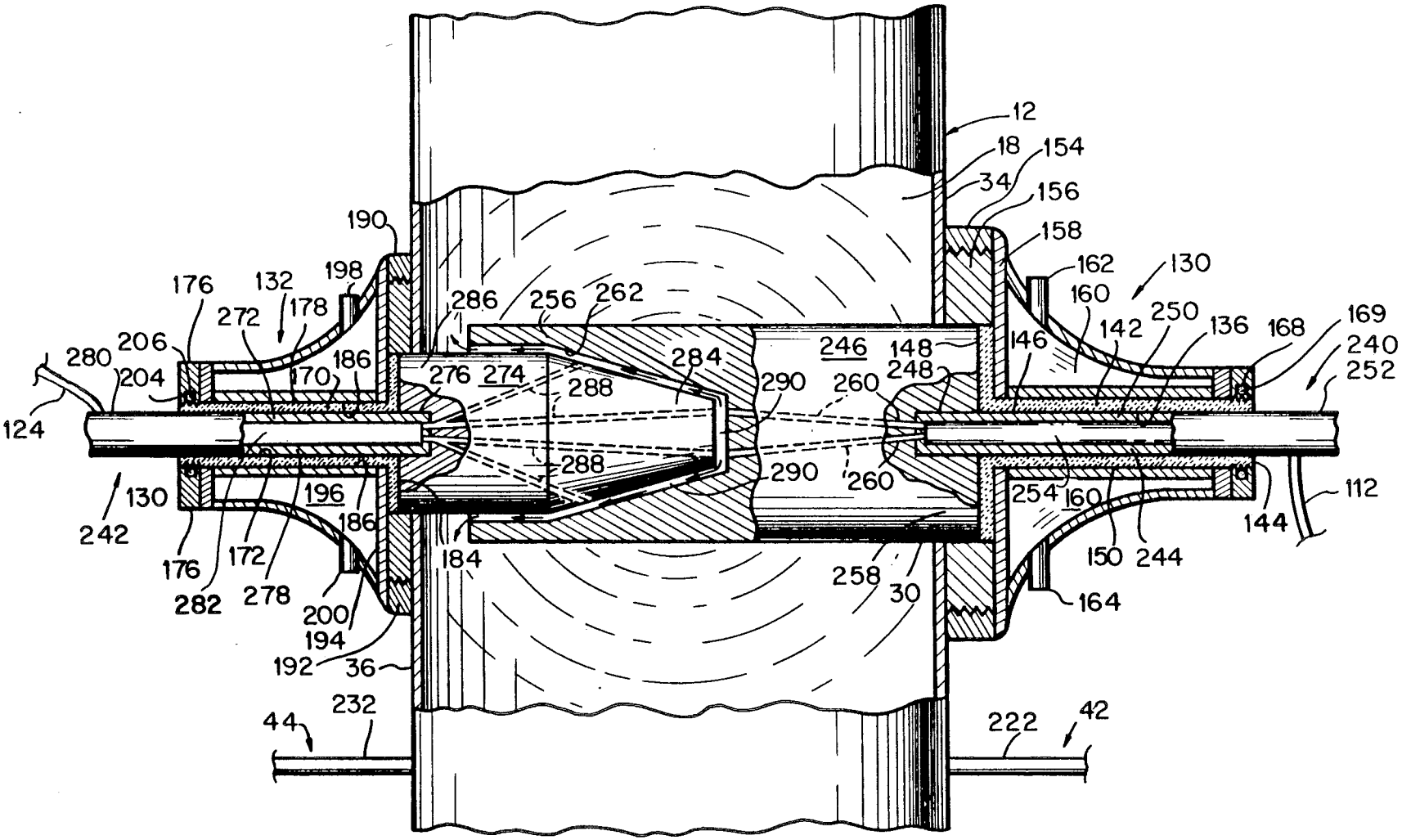
FIG. 3 is a fragmental, enlarged cross-sectional view of the induction arc chamber of FIG. 2 having an alternative embodiment of a pair of electrode assemblies.

Referring now to FIG. 3 a second embodiment of a first and second electrode assembly 240, 242 are illustrated. The first and second electrode assemblies 240, 242 are operably connected to the first and second travel assemblies 42, 44 in the same manner as the first and second electrode assemblies 20, 22 shown in FIGS. 1 and 2. Thus, the connection of the first and second electrode assemblies 240, 242 to the first and second travel assemblies 42, 44, respectively, will not be repeated herein but the prior description relating to the first and second travel assemblies 42, 44 is expressly incorporated by reference.

The first electrode assembly 240 comprises a first tubular member 244 fabricated of an electrical conductive material and a first carbon electrode 246. The first tubular member 244 is characterized as having a first end portion 248, a medial portion 250, an opposed second end portion 252 and a fluid flow passageway 254 extending therethrough. The first carbon electrode 246 is likewise characterized as having a first end portion 256, an opposed second end portion 258 and fluid flow passageways 260.

The first end portion 256 of the first carbon electrode 246 is provided with a substantially centrally disposed recessed portion 262 formed therein; and the opposed second end portion 258 of the first carbon electrode 246 is connected to and supported by the first end portion 248 of the first tubular member 244 so that the fluid flow passageway 254 of the first tubular member 244 is in fluid communication with the fluid flow passageways 260 of the first carbon electrode 246. In order to form a divergent fluid flow through the first carbon electrode 246, the fluid flow passageways 260 comprise a plurality of angularly disposed fluid flow passageways substantially as shown (See FIG. 3B).

The medial portion 250 of the first tubular member 244 is operably connected to the first sealing and cooling assembly 130 in the same manner as the first conducting member 102 of the first electrode assembly 20 heretofore described with reference to FIG. 2. Thus, the interconnection of the first tubular member 244 to the first sealing and cooling assembly 130 will not be repeated herein but is expressly incorporated by references.

Figure 3A:
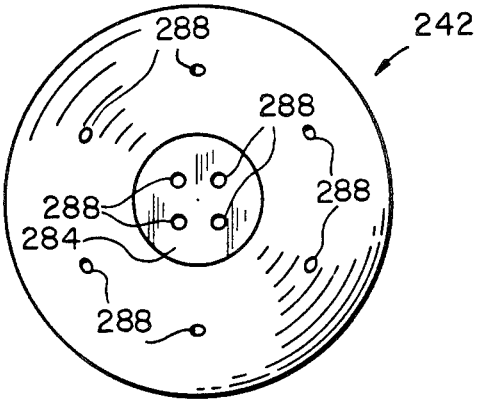
FIG. 3A is an end view of an electrode of one of the electrode assemblies of FIG. 3.

The second electrode assembly 242 comprises a second tubular member 272 fabricated of an electrically conductive material and a second carbon electrode 274. The second tubular member 272 is characterized as having a first end portion 276, a medial portion 278, an opposed second end portion 280 and a fluid flow passageway 282 extending therethrough. The second carbon electrode 274 is also characterized as having a first end portion 284, an opposed second end portion 286 and fluid flow passageways 288 (FIG. 3A).

The first end portion 284 of the second carbon electrode 274 is configured to correspond with the centrally disposed recessed portion 262 formed in the first end portion 256 of the first carbon electrode 246 so that the first end portion 284 of the second carbon electrode 274 is disposable within the recessed portion 262 of the first carbon electrode 246 to form an electric arc gap 290 therebetween. The opposed second end portion 286 of the second carbon electrode 274 is connected to and supported by the first end portion 276 of the second tubular member 272 so that the fluid flow passageway 282 of the second tubular member 272 openly communicates with the fluid flow passageways 288 of the second carbon electrode 274.

Thus, as fluid is injected through the fluid flow passageway 282 of the second tubular member 272, the flow of such fluid is diverted in an outwardly direction as same passes through the second carbon electrode 274 and the fluid is introduced into the electric arc gap 290 at various positions substantially as shown in FIG. 3.

The medial portion 278 of the second tubular member 272 is operably connected to the second sealing and cooling assembly 132 in the same manner as the second conducting member 114 of the second electrode assembly 22 heretofore described with reference to FIG. 2. Thus, the interconnection of the second tubular member 272 to the second sealing and cooling assembly 132 will not be repeated herein but is expressly incorporated by reference.

The construction of the first tubular member 244 and the first carbon electrode 246 of the first electrode assembly 240 and the second tubular member 272 and the second carbon electrode 274 of the second electrode assembly 242 permit one to introduce either fluid waste materials and/or a thermal enhancement fluid directly into the electric arc gap 290. Thus, the first and second tubular members 244, 272 are provided with connector members not shown so as to permit connection of the first and second electrode assemblies 240, 242 to containers containing fluid waste materials and/or thermal enhancement fluids.

Figure 4:
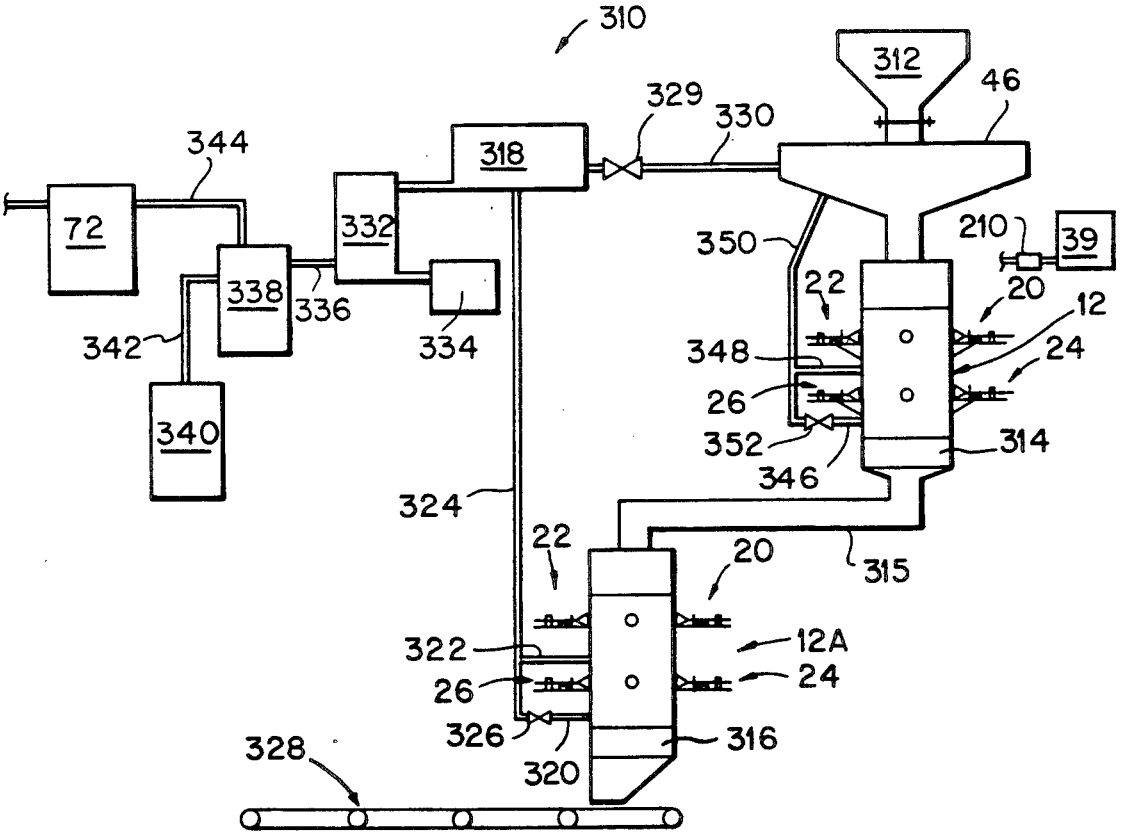
FIG. 4 is a schematic diagram illustrating an alternative embodiment of the present invention.

Referring now to FIG. 4 a second embodiment of an apparatus 310 for thermal decomposition of waste materials is illustrated. Certain components of the apparatus 310 are identical in construction and function to components of the apparatus 10 heretofore described. Such components of the apparatus 310 will be referred to with similar numbers as the components of the apparatus 10 where appropriate.

The apparatus 310 comprises an induction arc chamber 12 having an inlet port, a residue outlet port and a thermal decomposition cavity (not shown). A plurality of electrode assemblies 20, 22, 24 and 26 are supported by the induction arc chamber 12 so as to be disposed within the thermal decomposition cavity. When the electrode assemblies 20–26 are electrically energized by the power source 39 a high temperature turbulent zone is produced within the thermal decomposition cavity of the induction arc chamber 12. The induction arc chamber 12 and the electrode assemblies 20–26 have heretofore been described in detail with reference to FIGS. 1–3. Thus, a detailed description of such components will not be repeated herein but such are expressly incorporated by reference. When employing the apparatus 310 for the thermal decomposition of waste materials in accordance with the present invention, waste materials are fed into a shredder or hammer mill 312 to reduce the particulate size of the waste material to be thermally decomposed by passage through the high temperature turbulent zone in the induction arc chamber 12. The shredded or milled particulate material is then fed to a hopper assembly 46 for introduction into the induction arc chamber 12. As previously stated, because exhaust gases are generated during the thermal decomposition of waste materials in the induction arc chamber 12, the waste inlet port of induction arc chamber 12 is provided with a conventional air lock.

When the particulate waste material is subjected to the high temperature turbulent zone produced within the induction arc chamber 12 by activation of the electrode assemblies 20–26, a solid residue (i.e., ash) and exhaust gases are formed. The solid residue is passed from the induction arc chamber 12 to a second hammer mill 314. Particulate residue is then passed from the second hammer mill 314, via an auger assembly 315, into a second induction arc chamber 12A for additional decomposition. The second induction arc chamber chamber 12A is identical in construction and function to the induction arc chamber 12. The resulting solids residue is removed form the second induction arc chamber 12A and passed to a third hammer mill 316. The gaseous vapors produced in the second induction arc chamber 12A are passed to a scrubber 318 via conduits 320, 322 and 324 as shown. Depending upon the amount of exhaust gases generated in the second induction arc chamber 12A, one can, if desired selectively close off the conduit 320 with a valve 326 so that the exhaust gases from the second induction arc chamber 12A are passed to the scrubber 318 via the conduits 322 and 324. A substantially gas-free solids residue is discharged from the third hammer mill 316 onto a conveyor assembly 328.

Air is separated from the exhaust gases in the scrubber 318. Hot air separated by the scrubber 318 is passed from the scrubber 318, via a valve 329 and a conduit 330, to the hopper assembly 46 wherein the hot air is admixed with the particulate waste materials in the hopper assembly 46.

The exhaust gases separated from the air in the scrubber 318 are passed to a cyclone-type separator 332 wherein entrained solid particulate materials are removed and conveyed to a suitable container 334. The exhaust gases are passed from the cyclone-type separator 332, via a conduit 336, to a liquid separator 338 wherein condensed liquids are separated from the cooled exhaust gases. The condensed, separated liquids are then passed to a liquid storage tank 340 via a conduit 342, if required, and the separated exhaust gases are passed to a baghouse 72 via a conduit 344 to remove any remaining particulate material. Exhaust gases from the baghouse 72 can then be discharged into the atmosphere in an environmentally safe manner.

As previously stated, the thermal decomposition of the waste materials in the induction arc chamber 12 produces, in addition to the solid residue, exhaust gases. The exhaust gases produced in the induction arc chamber 12 are passed to the hopper assembly 46, via conduits 346, 348 and 350, for admixture with the solid waste materials in the hopper assembly 46 and the hot air from the scrubber 318. When it is determined that the exhaust gases produced in the induction arc chamber 12 can be adequately passed to the hopper assembly 46 through the conduits 348 and 350, a valve 352 communicating with the conduit 346 can be closed so that all of the exhaust gases are passed from the induction arc chamber 12 to the hopper assembly 46 via the conduits 348 and 350.

While certain select components have been depicted in both FIGS. 1 and 4 for the thermal decomposition of waste materials, it should be understood that additional components can be incorporated into the apparatus 10 and 310 to further treat the solid residue (i.e., ash) and the exhaust gases generated by the thermal decomposition of waste materials in the induction arc chamber 12. Further, all valves and gages employed in the apparatus 10 and 310 have not been depicted for clarity, but the incorporation of valves and gages are within the knowledge of those skilled in the art. Referring again to FIGS. 1 and 2, the thermal decomposition of waste material will now be described with reference to the apparatus 10. When the waste materials to be thermally decomposed are in the solid state, the waste materials are introduced into the hopper assembly 46. Thereafter, the electrode assemblies such as electrode assemblies 20–26 are activated by the power source 39 so that the electric arc gap 38 is formed between oppositely disposed pairs of electrodes, such as the first and second electrode assemblies 20, 22 (FIG. 2). The first and second travel assemblies 42, 44 are also activated so that the electric arc gap 38 formed between the electrode assemblies can be varied to produce the desired temperature within the high temper ature turbulent zone 28 as determined by the temperature sensing and control assembly 210.

Once it has been determined that the temperature of the high temperature turbulent zone 28 has reached a sufficient temperature to thermally decompose the waste material, the waste material is discharged into the thermal decomposition cavity 18 of the induction arc chamber 12 for contact with the high temperature turbulence zone 28. The waste material is maintained in contact with the high temperature turbulent zone 28 for a period of time effective to insure thermal decomposition of the waste material at the temperature of the high temperature turbulent zone 28. When the temperature sensing and control assembly 210 detect a change in the temperature in the high temperature turbulent zone 28 it selectively activates the first and second travel assemblies 42, 44 to vary the electric arc gap 38 between the electrode assemblies 20, 22, in order to maintain the temperature in the high temperature turbulent zone 28 at a desired level.

To enhance the temperature of the high temperature turbulent zone 28 as well as to insure that a sufficient temperature is maintained therein to thermally decompose the waste material introduced into the induction arc chamber 12, a thermal enhancement fluid can be introduced into the thermal decomposition cavity 18 and thus into the high temperature turbulent zone 28. The thermal enhancement fluid can be introduced into the induction arc chamber 12 via the conduit 66 and the valve 68 when employing the first and second electrode assemblies 20, 22 as illustrated in FIG. 2, or through the electrode assemblies themselves when employing electrode assemblies constructed in accordance with the first and second electrode assemblies 240, 242 illustrated in FIGS. 3, 3A and 3B.

When the waste material has been maintained in the thermal decomposition cavity 18 of the induction arc chamber 12 for a sufficient period of time to insure effective decomposition of the waste materials, the gases generated during the thermal decomposition of the waste materials are exhausted from either the thermal decomposition cavity 18 of the induction arc chamber 12 or the auger assembly 52 (depending upon the construction of the apparatus 10) and passed to the cooling system 56 so as to avoid the formation of toxic byproducts. Further, any suspended or entrained particulate materials are removed from the exhaust gases by the cooling system 56. The cooled, substantially particulate free exhaust gases are then passed to the trayed tower 82 wherein such exhaust gases are neutralized, if required, prior to venting to the atmosphere.

The solid residue formed by the thermal decomposition of the waste material in the induction arc chamber 12 is withdrawn from the induction arc chamber 12 via its residue outlet port. As shown in FIG. 1, the solid residue is passed into the auger assembly 52 wherein gaseous vapors are separated from the solid residue and the separated gaseous vapors are passed to the cooling system 56 wherein the exhaust gases are rapidly cooled and entrained or suspended particulate material removed therefrom.

Figure 3B:
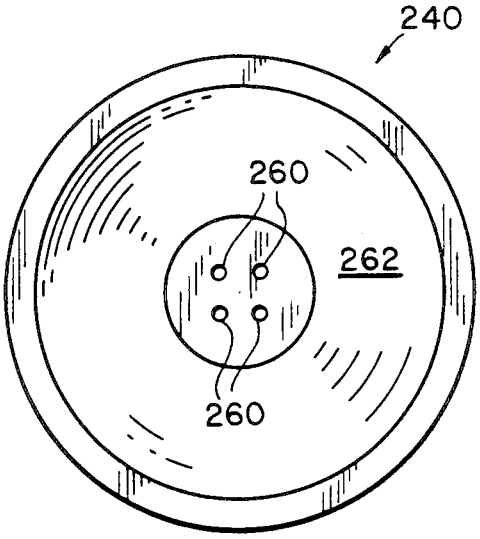
FIG. 3B is an end view of another electrode of the electrode assemblies of FIG. 3.

When employing the apparatus 10 for the thermal destruction of waste materials in the fluid state, it is often desirable to use as the electrode assemblies the first and second electrode assemblies 240 and 242 illustrated in FIGS. 3–3B. When employing such electrode assemblies the liquid waste materials can be injected into the induction arc chamber 12 through the first and second electrode assemblies 240, 242 and into contact with the high temperature turbulent zone 28 via the electric arc gap 290 formed between the electrodes. Alternatively, if one employs the apparatus 10 having electrodes with the configuration of the first and second electrode assemblies 20, 22 illustrated in FIG. 2, liquid waste materials can be fed into the thermal decomposition cavity 18 of the induction arc chamber 12 via the conduit 66 and the valve 68.

From the above, it will be appreciated that the thermal decomposition of waste materials employing an induction arc chamber comprising at least one pair of electrode assemblies wherein the electric arc gap formed therebetween can be selectively varied in order to effectively control the temperature in a high temperature turbulent zone produced in the induction arc chamber permits one to efficiently and effectively decompose waste materials, while insuring that the temperature of the high temperature turbulent zone is maintained at a sufficiently high temperature to decompose the waste materials introduced into the induction arc chamber.

Further, it is clear that the present invention is well adapted to carry out the objects and to obtain the ends and advantages mentioned as well as those inherent therein. While presently preferred embodiments of the invention have been described for the purposes of this disclosure, it will be recognized that numerous changes may be made which will readily suggest themselves to those skilled in the art and which are encompassed in the spirit of the invention disclosed as defined in the appended claims.

We claim:

1. An apparatus for thermal decomposition of waste materials comprising:

an induction arc chamber having a waste inlet port, a residue outlet port and defining a thermal decomposition cavity therein;

electrode means supported within the thermal decomposition cavity for creating a high temperature turbulent zone within the thermal decomposition cavity when electrically energized, the electrode means having an electric arc gap which is selectively variable;

travel means operably connected to the electrode means for selectively maintaining the electric arc gap so that a sufficient high temperature is maintainable to decompose waste materials passed through the high temperature turbulent zone in the thermal decomposition cavity;

power means for electrically energizing the electrode means;

means for feeding waste materials into the thermal decomposition cavity via the inlet port;

means for receiving non-toxic particulate material discharged from the induction arc chamber through the residue outlet port; and air lock means supported by the induction arc chamber for effectively sealing the inlet port and for preventing gases generated during the thermal decomposition of the waste materials from escaping through the inlet port.

2. An apparatus for thermal decomposition of waste materials comprising:

an induction arc chamber having oppositely disposed electrode ports and defining a thermal decomposition cavity therein;

electrode means supported within the electrode ports of the induction arc chamber and extending into the thermal decomposition cavity for creating a high temperature turbulent zone within the thermal decomposition cavity when electrically energized, the electrode means having an electric arc gap which is selectively variable, the electrode means comprising:

a first electrode assembly having a first electrode disposable within the thermal decomposition cavity and a second electrode assembly having a second electrode disposable within the thermal decomposition cavity such that the selectively variable electric arc gap is formed therebetween;

travel means operably connected to the electrode means for selectively maintaining the electric arc gap so that a sufficiently high temperature is maintainable to decompose waste materials passed through the high temperature turbulent zone in the thermal decomposition cavity;

power means for electrically energizing the electrode means; and motor means operably connected to the first electrode for imparting rotation to the first electrode when the motor means is actuated.

3. An apparatus for thermal decomposition of waste materials comprising:

an induction arc chamber defining a thermal decomposition cavity therein;

electrode means supported within the thermal decomposition cavity for creating a high temperature turbulent zone within the thermal decomposition cavity when electrically energized, the electrode means having a variable arc gap which is selectively variable, the electrode means comprising:

first and second electrodes fabricated of carbon such that the second electrode further function as an additional fuel source for the induction arc chamber;

travel means operably connected to the first and second electrodes for selectively maintaining the electric arc gap so that a sufficiently high temperature is maintainable to decompose waste materials passed through the high temperature turbulent zone in the thermal decomposition cavity; and D.C. power means for electrically energizing the first and second electrodes.

4. An apparatus for thermal decomposition of waste materials comprising:

an induction arc chamber defining a thermal decomposition cavity therein;

electrode means supported within the thermal decomposition cavity for creating a high temperature turbulent zone within the thermal decomposition cavity when electrically energized, the electrode means having an electric arc gap which is relatively variable;

travel means operably connected to the electrode means for selectively maintaining the electric arc gap so that a sufficiently high temperature is maintainable to decompose waste materials passed through the high temperature turbulent zone in the thermal decomposition cavity;

power means for electrically energizing the electrode means; and means for injecting a thermal enhancement gas into the high temperature turbulent thermal zone.

5. An apparatus for thermal decomposition of waste materials comprising:

an induction arc chamber having at least two oppositely disposed electrode ports and defining a thermal decomposition cavity therein;

a first electrode assembly supported within one of the electrode ports and a second electrode assembly supported within the other electrode port so as to create a high temperature turbulent zone within the thermal decomposition cavity when electrically energized, the first and second electrode assemblies having an electric arc gap therebetween which is selectively variable, the first electrode assembly comprising:

a first conducting member having a first end portion and an opposed second end portion; and a first electrode supported on the first end portion of the first conducting member such that in an assemblied position the first electrode is disposed within the thermal decomposition cavity of the induction arc chamber and the opposed second end portion of the first conducting member extends outwardly from the induction arc chamber so as to be connectable to the power means and the travel means; and the second electrode assembly comprising:

a second conducting member having a first end portion and an opposed second end portion; and a second electrode supported on the first end portion of the second conducting member such that in an assemblied position the second electrode is disposed within the thermal decomposition cavity of the induction arc chamber and the electric arc gap is formed between the first and second electrodes, the opposed second end portion of the second conducting member extending outwardly from the induction arc chamber;

travel means operably connected to the first and second conducting members for selectively maintaining the electric arc gap between the first and second electrodes so that a sufficiently high temperature is maintainable to decompose waste materials passed through the high temperature turbulent zone in the thermal decomposition cavity, the travel means comprising:

a carriage means for supporting the first and second conducting members and for defining a travel path for the first and second conducting members so that the first and second conducting members can be reciprocally moved relative to each other;

step motor means connected to the carriage means for reciprocally moving the first and second conducting members upon actuation of the step motor means so as to selectively maintain the electric arc gap between the first and second electrodes; and sensing and control means for determining the effective temperature in the high temperature turbulent zone and for producing a signal indication of such temperature so as to actuate the step motor means;

power means for electrically energizing the first and second electrodes; and means for forming a substantially fluid-tight seal between the first and second conducting members and for cooling the first and second conducting members while permitting the first and second conducting members to be reciprocally moved relative to each other so that the electric arc gap formed between the first and second electrodes is selectively maintained.

6. An apparatus for thermal decomposition of waste materials comprising:

an induction arc chamber having at least two oppositely disposed electrode ports and defining a thermal decomposition cavity therein;

electrode means for creating a high temperature turbulent zone within the thermal decomposition cavity when electrically energized, the electrode means having an electric arc gap which is selectively variable, the electrode means comprising: a first electrode assembly supported within one of the electrode ports and a second electrode assembly supported within the other of the electrode ports, the first electrode assembly comprising:

a first tubular member fabricated of an electrical conductive material, the first tubular member having a first end portion, an opposed second end portion and a fluid flow passageway extending therebetween;

a first carbon electrode having a first end portion, an opposed second end portion and a fluid flow passageway extending therebetween, the first end portion having a substantially centrally disposed recessed portion formed therein and the opposed second end portion of the first carbon electrode connected to and supported by the first end portion of the first tubular member so that the fluid flow passageway of the first tubular member is in fluid communication with the fluid flow passageway of the first carbon electrode;

the second electrode assembly comprising:

a second tubular member fabricated of an electrically conductive material, the second tubular member having a first end portion, an opposed second end portion and fluid flow passageway extending therebetween; and a second carbon electrode having a first end portion, an opposed second end portion and a fluid flow passageway extending therebetween, the first end portion of the second carbon electrode configured to correspond with the centrally disposed recessed portion formed in the first end portion of the first carbon electrode such that the first end portion of the second carbon electrode is disposable within the recessed portion of the first carbon electrode to form the electric arc gap therebetween, the opposed second end portion of the second carbon electrode connected to and supported by the first end portion so that the fluid flow passageway of the second tubular member is in fluid communication with the fluid flow passageway of the second carbon electrode;

travel means operably connected to the first and second tubular members for selectively maintaining the electric arc gap between the first and second carbon electrodes so that a sufficiently high temperature is maintainable to decompose waste materials passed through the high temperature turbulent zone in the thermal decomposition cavity; and power means for electrically energizing the first and second carbon electrodes.

7. A method for the thermal decomposition of waste material comprising the steps of:

producing a high temperature zone of thermal turbulence within a thermal decomposition cavity of an induction chamber by electrical activation of at least one pair of electrodes extending therein and separated by a variable gap therebetween;

introducing the waste materials into the thermal decomposition chamber;

controlling the gap width between electrodes so that a sufficiently high temperature is maintained to substantially thermally decompose the waste material to form non-toxic products; and introducing a thermal enhancement gas into the thermal decomposition cavity to enhance the temperature of the high temperature turbulence zone.

8. A method for the thermal decomposition of waste materials comprising the steps of:

producing a high temperature zone of thermal turbulence within a thermal decomposition cavity of an induction arc chamber by electrical activation of at least one pair of electrodes extending therein and separated by a variable gap therebetween;

introducing the waste materials into the thermal decomposition cavity;

controlling the gap width between electrodes so that a sufficiently high temperature is maintained to substantially thermally decompose the waste material to form non-toxic products;

withdrawing particulate materials resulting from the thermal decomposition of the waste materials from the induction arc chamber;

separating gaseous vapors from the withdrawn particulate materials; and rapidly cooling the gaseous vapors.

9. A method for the thermal decomposition of waste materials comprising the steps of:

producing a high temperature zone of thermal turbulence within a thermal decomposition cavity of an induction arc chamber by electrical activation of at least one pair electrodes extending therein and separated by a variable gap therebetween;

introducing the waste materials into the thermal decomposition cavity;

controlling the gap width between electrodes so that a sufficiently high temperature is maintained to substantially thermally decompose the waste material to form non-toxic products;

measuring the energy requirements of the electrode to provide a signal representative thereof so as to actuate a travel assembly monitoring the temperature of the high temperature zone of thermal turbulence and utilizing such data to control the gap width between the electrodes.

10. The apparatus of claim 1 wherein the induction arc chamber is provided with a gas exhaust port and wherein the apparatus further comprises:

cooling means in fluid communication with the induction arc chamber for receiving exhaust gases generated by the thermal decomposition of the waste materials in the thermal decomposition cavity and for rapidly cooling the gases prior to venting or subjecting such cooled gases to further processing.

11. The apparatus of claim 1 further comprising:

valve means supported by the induction arc chamber for selectively opening and closing the residue outlet port.

12. The apparatus of claim 11 wherein the means for receiving non-toxic particulate material discharged from the induction arc chamber comprises auger means communicating with the residue outlet port for receiving the particulate materials from the thermal decomposition cavity via the residue outlet port.

13. The apparatus of claim 12 wherein the auger means is provided with a gas exhaust port and wherein the apparatus further comprises:

cooling means operably connected to and in fluid communication with the gas exhaust port of the auger means for receiving exhaust gases therefrom and for cooling such exhaust gases to remove suspended particulate materials contained therein.

14. The apparatus of claim 13 further comprising:

tower means connected to and in fluid communication with the cooling means for receiving the cooled exhaust gases; and means for injecting neutralizing agents into the tower means to effectively neutralize the cooled exhaust gases.

15. The apparatus of claim 2 further comprising:

second motor means operably connected to the second electrode assembly for imparting rotation to the second electrode when the second motor means is actuated.

16. The apparatus of claim 5 wherein the apparatus further comprises:

means for sensing and determining the temperature of the high temperature turbulent zone and for actuating the travel means in response thereto.

17. The apparatus of claim 5 wherein the induction arc chamber is provided with a gas exhaust port and wherein the apparatus further comprises:

cooling means in fluid communication with the induction arc chamber for receiving exhaust gases generated by the thermal decomposition of the waste materials in the thermal decomposition cavity and for rapidly cooling the gases prior to venting or subjecting such cooled gases to further processing.

18. The apparatus of claim 17 wherein the induction arc chamber is provided with a waste inlet port and a residue outlet port and wherein the apparatus further comprising:

means for feeding waste materials into the thermal decomposition cavity via the inlet port; and means for receiving non-toxic particulate material discharged from the induction arc chamber through the residue outlet port.

19. The apparatus of claim 18 further comprising air lock means supported by the induction arc chamber for effectively sealing the inlet port and for preventing gases generated during the thermal decomposition of the waste materials from escaping through the inlet port.

20. The apparatus of claim 19 further comprising valve means supported by the induction arc chamber for selectively opening and closing the residue outlet port.

21. The apparatus of claim 20 wherein the means for receiving non-toxic particulate material discharged from the induction arc chamber comprises auger means communicating with the residue outlet port for receiving the particulate materials from the thermal decomposition cavity via the residue outlet port.

22. The apparatus of claim 21 wherein the auger means is provided with a gas exhaust port and wherein the apparatus further comprises:

cooling means operably connected to and in fluid communication with the gas exhaust port of the auger means for receiving exhaust gases and for cooling such exhaust gases to remove suspended particulate materials therefrom.

23. The apparatus of claim 22 further comprising:

tower means connected to and in fluid communication with the cooling means for receiving the cooled exhaust gases; and means for injecting neutralizing agents into the tower means to effectively neutralize the cooled exhaust gases.

24. The apparatus of claim 6 further comprising:

cooling and sealing means for cooling the first and second conducting members when the first and second electrodes are electrically energized, the cooling and sealing means encompassing at least a portion of the first and second conducting members so as to form a substantially fluid-tight seal therebetween while permitting the first and second conducting members and thus the first and second electrodes to be reciprocally moved relative to one another upon actuation of the step motor means.

25. The apparatus of claim 24 further comprising means connectable to the opposed second end portion of the first tubular member for injecting fluid waste materials into the electric arc gap formed between the first and second carbon electrodes and into contact with the high temperature turbulent thermal zone.

26. The apparatus of claim 25 wherein the first carbon electrode is provided with a plurality of bores extending from its exterior surface to the fluid flow passageway of the first tubular member, the second carbon electrode is provided with at least one bore extending from its second end portion so as to openly communicate with the fluid flow passageway of the second tubular member, and wherein the apparatus further comprises:

means connectable to the second end portion of the second tubular member for injecting a thermal enhancement fluid into the electric arc gap via the fluid flow passageway of the second tubular member and the bore of the second carbon electrode for enhancing the temperature of the high temperature turbulent thermal zone.

27. The method of claim 7 further comprising the step of:

rapidly cooling gases exhausted from the thermal decomposition cavity to avoid formation of toxic byproducts during cooling of the gases and to separate suspended particulate materials therefrom.

28. The method of claim 8 further comprising:

removing suspended particulate materials from the cooled gaseous vapors; and neutralizing the particulate-free cooled gaseous vapors.

29. The method of claim 28 wherein the waste material is in the fluid state and the waste material is injected into the gap between the electrodes.

30. An apparatus for thermal decomposition of waste materials comprising:

an induction arc chamber;

means for passing a thermal enhancement gas into the induction arc chamber;

electrode means supported within the induction arc chamber for creating a high temperature thermal zone when electrically energized, the electrode means having an electric arc gap which is selectively variable;

travel means operably connected to the electrode means for selectively maintaining the electric arc gap, the electrode means, the means for passing the thermal enhancement gas into the induction arc chamber and the travel means for selectively maintaining the electric arc gap cooperating to define a high temperature turbulent thermal zone in which a sufficiently high temperature is maintainable for a sufficient period of time to thermally decompose waste materials passed therethrough; and power means for electrically energizing the electrode means.

31. The apparatus of claim 30 wherein the travel means comprises:

carriage means for supporting the electrode means;

step motor means connected to the carriage means for imparting reciprocal movement to the electrode means so that the electric arc gap of the electrode means in selectively maintained; and means for determining the temperature in the high temperature turbulent zone and for actuating the step motor means in response thereto.

32. The apparatus of claim 31 wherein the induction arc chamber is provided with a waste materials inlet opening and a residue outlet opening and wherein the apparatus further comprises:

means for feeding waste materials into the induction arc chamber via the waste materials inlet opening; and means for receiving non-toxic materials discharged from the induction arc chamber through the residue outlet port.

33. The apparatus of claim 31 wherein the induction arc chamber is provided with oppositely disposed electrode ports adapted to supportingly receive the electrode means and wherein the electrode means comprises a first electrode assembly having a first electrode extending inwardly into the thermal decomposition cavity and a second electrode assembly having a second electrode extending inwardly into the thermal decomposition cavity, the first and second electrodes being disposed opposite each other so that the electric arc gap is formed therebetween.

34. The apparatus of claim 33 further comprising:

motor means operably connected to the first electrode assembly for imparting rotation to the first electrode when the motor means is actuated.

35. The apparatus of claim 34 further comprising:

second motor means operably connected to the second electrode assembly for imparting rotation to the second electrode when the second motor means is actuated.

36. The apparatus of claim 31 wherein the induction arc chamber is provided with at least two oppositely disposed electrode ports and wherein the electrode means comprises a first electrode assembly supported within one of the electrode ports and a second electrode assembly supported within the other electrode port, the first electrode assembly comprising:

a first conducting member having a first end portion and an opposed second end portion; and a first electrode supported on the first end portion of the first conducting member such that in an assembled position the first electrode is disposed within the thermal decomposition cavity of the induction arc chamber and the opposed second end portion of the first conducting member extends outwardly from the induction arc chamber so as to be connectable to the power means and the travel means; and the second electrode assembly comprising:

a second conducting member having a first end portion and an opposed second end portion., and a second electrode supported on the first end portion of the second conducting member such that in an assembled position the second electrode is disposed within the thermal decomposition cavity of the induction arc chamber and the electric arc gap is formed between the first and second electrodes, the opposed second end portion of the second conducting member extending outwardly from the induction arc chamber so as to be connectable to the power means and the travel means.

37. The apparatus of claim 36 further comprising:

electrode cooling and sealing means for cooling the first and second conducting members when the first and second electrodes are electrically energized, the electrode cooling and sealing means encompassing a portion of the first and second conducting members so as to form a substantially fluid-tight seal therebetween while permitting the first and second conducting members and thus the first and second electrodes to be reciprocally moved relative to one another upon activation of the step motor means.

38. The apparatus of claim 37 wherein the apparatus is provided with a gas exhaust port for exhausting gases generated during the thermal decomposition of the waste material and wherein the apparatus further comprises:

cooling means in fluid communication with the gas exhaust port for receiving gases exhausted through the gas exhaust port and for cooling the exhaust gases and for separating suspended particulate material present in the exhaust gases.

39. The apparatus of claim 38 wherein the induction arc chamber is provided with a waste inlet port and residue outlet port and wherein the apparatus further comprises:

means for feeding waste materials into the thermal decomposition cavity via the inlet port; and means for receiving non-toxic particulate material discharged from the induction arc chamber through the residue outlet port.

40. The apparatus of claim 39 wherein the means for receiving non-toxic particulate material discharged from the induction arc chamber comprises auger means communicating with the residue outlet port for receiving the particulate materials from the thermal decomposition cavity via the residue outlet port.

41. The apparatus of claim 40 further comprising valve means supported by the induction arc chamber for selectively opening and closing the residue outlet port.

42. The apparatus of claim 41 further comprising air lock means supported by the induction arc chamber for effectively sealing the inlet port and for preventing gases generated during the thermal decomposition of the waste material from escaping through the inlet port.

43. The apparatus of claim 42 wherein the gas exhaust port is provided in the auger means and wherein the apparatus further comprises:

tower means connected to and in fluid communication with the cooling means for receiving the cooled gases; and means for injecting neutralizing agents into the tower means to neutralize the cooled exhaust gases.

* * * * *

UNITED STATES PATENT AND TRADEMARK OFFICE

CERTIFICATE OF CORRECTION

PATENT NO. : 5,095,828

DATED : March 17, 1992

INVENTOR(S) : Harold H. Holden; Harold S. Holden; and Andrew W. Marr, Jr.

It is certified that error appears in the above-indentified patent and that said Letters Patent is hereby corrected as shown below:

Column 5, line 7, delete "ga" and substitute therefor --gap--;

Column 6, line 27, after "valve 68." begin a new paragraph;

Column 13, line 38, after "reference." begin a new paragraph;

Column 14, line 55, after "art." begin a new paragraph; and

Signed and Sealed this

Twenty-second Day of March, 1994

*Attest:*

Bruce Lehman

BRUCE LEHMAN

*Attesting Officer*

*Commissioner of Patents and Trademarks*